US008257520B2

(12) United States Patent
Gash et al.

(10) Patent No.: US 8,257,520 B2
(45) Date of Patent: Sep. 4, 2012

(54) ORGANIZED ENERGETIC COMPOSITES BASED ON MICRO AND NANOSTRUCTURES AND METHODS THEREOF

(75) Inventors: Alexander E. Gash, Brentwood, CA (US); Thomas Yong-Jin Han, Livermore, CA (US); Donald J. Sirbuly, Mountain House, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 213 days.

(21) Appl. No.: 12/392,025

(22) Filed: Feb. 24, 2009

(65) Prior Publication Data

US 2010/0212787 A1 Aug. 26, 2010

(51) Int. Cl.

| | |
|---|---|
| ***C06B 45/00*** | (2006.01) |
| ***C06B 45/04*** | (2006.01) |
| ***D03D 23/00*** | (2006.01) |
| ***D03D 43/00*** | (2006.01) |

(52) U.S. Cl. ..... 149/2; 149/17; 149/108.2; 149/109.2; 149/109.4

(58) Field of Classification Search ..... 149/2, 17, 149/108.2, 109.2, 109.4; 977/707
See application file for complete search history.

(56) References Cited

U.S. PATENT DOCUMENTS

| | | | | |
|---|---|---|---|---|
| 5,538,795 | A * | 7/1996 | Barbee et al. | 428/420 |
| 5,547,715 | A * | 8/1996 | Barbee et al. | 427/561 |
| 6,638,491 | B2 * | 10/2003 | Carberry | 423/348 |
| 6,803,244 | B2 * | 10/2004 | Diener et al. | 438/22 |
| 6,869,542 | B2 * | 3/2005 | Desphande et al. | 216/51 |
| 2004/0244889 | A1 * | 12/2004 | Sailor et al. | 149/2 |
| 2006/0223312 | A1 * | 10/2006 | Yonker et al. | 438/674 |
| 2006/0276040 | A1 | 12/2006 | Abraham | 438/689 |
| 2007/0105321 | A1 | 5/2007 | Lee et al. | 438/270 |
| 2007/0138705 | A1 | 6/2007 | Mickelson et al. | 264/405 |

FOREIGN PATENT DOCUMENTS

| | | |
|---|---|---|
| WO | 2005/072089 | 8/2005 |
| WO | 2006/105466 | 10/2006 |
| WO | 2007/018542 | 2/2007 |

OTHER PUBLICATIONS

D. Clement et al., "Highly explosive nanosilicon-based composite materials" 2005 Wiley-VCH Verlag GmbH & Co. KGaA, Weinheim; May 19, 2005.

Sirbuly et al., "Patterned Microstructures of Porous Silicon by Dry-Removal Soft Lithography" 2003 Wiley-VCH Verlag GmbH & Co. KGaA, Weinheim; Adv. Mater. 2003. 15, No. 2, Jan. 16.

Kovalev et al., "Strong Explosive Interaction of Hydrogenated Porous Silicon with Oxygen at Cryogenic Temperatures" The American Physical Society, vol. 87, No. 6; Aug. 6, 2001.

* cited by examiner

*Primary Examiner* — James McDonough
(74) *Attorney, Agent, or Firm* — Dominic M. Kotab

(57) ABSTRACT

An ordered energetic composite structure according to one embodiment includes an ordered array of metal fuel portions; and an oxidizer in gaps located between the metal fuel portions. An ordered energetic composite structure according to another embodiment includes at least one metal fuel portion having an ordered array of nanopores; and an oxidizer in the nanopores. A method for forming an ordered energetic composite structure according to one embodiment includes forming an ordered array of metal fuel portions; and depositing an oxidizer in gaps located between the metal fuel portions. A method for forming an ordered energetic composite structure according to another embodiment includes forming an ordered array of nanopores in at least one metal fuel portion; and depositing an oxidizer in the nanopores.

10 Claims, 5 Drawing Sheets

ORGANIZED ENERGETIC COMPOSITES BASED ON MICRO AND NANOSTRUCTURES AND METHODS THEREOF

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to energetic composites, and more particularly to energetic composites based on micro and nanostructures underlying or in the composites.

BACKGROUND

Microenergetic materials are energetic materials that are assembled in such a manner as to give structures with dimensions from tens to hundreds of micrometers. Integration of these energetic materials into microsystems in which the energy released (mechanical, thermal, chemical) through a reaction decomposition may be utilized is highly desired but has been elusive to achieve. Systems continue to be miniaturized, thus there is a strong desire to develop energetic materials with high efficiency in smaller volumes.

For materials in these types of microsystems, energy release (combustion, deflagration) characteristics at the mesoscale are critical. The term "mesoscale" is used to define a range of length scales that span from bulk, e.g., millimeter (mm) to centimeter (cm), to the molecular level, e.g., Angstrom (Å) to nanometer (nm). The success or failure of combusting an energetic material is linked to mesoscale phenomena. Such processes include conductive and convective combustion, radiation, and heat losses due to high surface area to volume ratios. Typically, success of materials in these applications is dependent, at least in part, on the rate of reaction propagation verses heat losses to the substrate. For example, most traditional monomolecular energetic materials, e.g., trinitrotoluene (TNT), cyclotrimethylene-trinitramine (RDX), High-Molecular-Weight RDX (HMX), etc., used in macroscale applications have failure diameters of at least a few millimeters and therefore are poor candidates for microenergetics. Therefore, it would be desirable to have a high total energy and fast reaction rate in a composite for use in microsystems.

Previous attempts at manufacturing explosives that use metal fuel, including compositions of Si (porous Si, or Si particles) in fuel/oxidant energetic mixtures have relied on metal fuel in a powder form that is affected by many other factors and influences. Moreover, the random nature of mixing particles lends to areas of aggregation of one material or the other, thereby diminishing effectiveness of the mix.

Material, energetic nanolaminates, that consist of alternating layers of metals that have exothermic heats of alloying have been described and are known. The resulting thin film structure is organized in 2-dimensions. The material is fabricated by sputtering mechanical roll-milling. However, successful attempts at incorporating such laminates into microenergetic materials have been elusive.

It would be desirable to have a metal fuel energetic composite that could have better overall rates of reaction, total energy output, and efficient manufacturability as compared to existing materials and methods of manufacturing.

SUMMARY

An ordered energetic composite structure according to one embodiment includes an ordered array of metal fuel portions; and an oxidizer in gaps located between the metal fuel portions.

An ordered energetic composite structure according to another embodiment includes at least one metal fuel portion having an ordered array of nanopores; and an oxidizer in the nanopores.

A method for forming an ordered energetic composite structure according to one embodiment includes forming an ordered array of metal fuel portions; and depositing an oxidizer in gaps located between the metal fuel portions.

A method for forming an ordered energetic composite structure according to another embodiment includes forming an ordered array of nanopores in at least one metal fuel portion; and depositing an oxidizer in the nanopores.

Other aspects and advantages of the present invention will become apparent from the following detailed description, which, when taken in conjunction with the drawings, illustrate by way of example the principles of the invention.

DETAILED DESCRIPTION

Figure 1A:
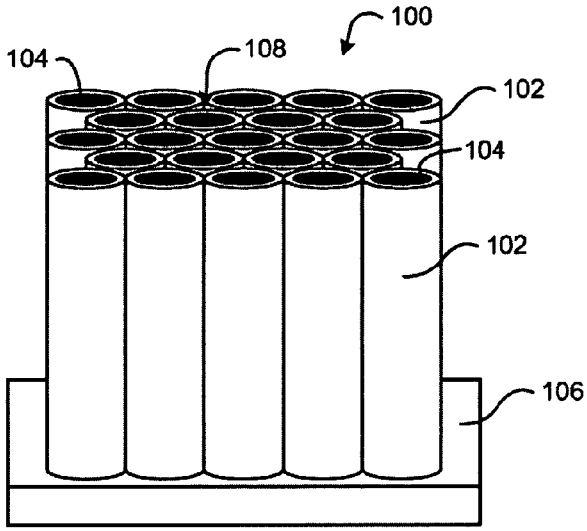
FIG. 1A shows a side-view schematic of an ordered energetic composite structure according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

In one general embodiment, an ordered energetic composite structure comprises an ordered array of metal fuel portions, and an oxidizer in gaps located between the metal fuel portions.

In another general embodiment, an ordered energetic composite structure comprises at least one metal fuel portion having an ordered array of nanopores, and an oxidizer in the nanopores.

In another general embodiment, a method for forming an ordered energetic composite structure comprises forming an ordered array of metal fuel portions, and depositing an oxidizer in gaps located between the metal fuel portions.

In another general embodiment, a method for forming an ordered energetic composite structure comprises forming an ordered array of nanopores in at least one metal fuel portion, and depositing an oxidizer in the nanopores.

Certain embodiments, as disclosed herein, can be distinguished from the prior art in several ways. The methods described herein for fabricating a fuel/oxidant composite include respective domains of reactants which are deposited in well defined locations. These locations are defined by the respective nano/microstructure of the metal fuel (such as Si), whether the structure is an array of one dimensional nanowires or nanopores. This method allows for high surface area mixing of the oxidizer and the fuel (which enables rapid reaction rates) as well as an organized arrangement of these constituents, which minimizes non-productive reactions and thus achieves a more precise oxidizer/fuel balance. The more precise oxidizer/fuel balance, along with other unique features described above, allow for tailoring of the output and the performance of the energetic reaction by varying the underlying nano/microstructure of the metal fuel.

Also, the disclosed embodiments are distinct from the prior art in that they encompass reactants that consist of oxidizers and fuels and the method of manufacture involves sol-gel, electrochemical, chemical vapor deposition, and soft lithography methods, as opposed to sputtering or mechanical roll-milling which is typically used in some prior art techniques.

In some embodiments, the disclosed embodiments may be used in the field of microenergetics, by providing new energetic materials with tailored energy release properties, which may be more easily integrated with existing semiconductor industrial infrastructure and processes. Understanding and quantifying combustion at the mesoscale is important for applications in these small-volume energy-demanding systems.

A novel class of energetic nanocomposites, specifically ordered energetic nanocomposites (OEN), can be manufactured through directed and engineered assembly of energetic constituents. These innovative materials may provide a striking improvement over current energetic nanocompositions when the metrics of performance, manufacturability, cost, life cycle, and/or safety are considered. OEN's have been found to have exceptional energy release properties, especially those properties related to combustion at the mesoscale. The energy release properties of OEN's are distinct and superior to current energetic nanocompositions.

Energetic nanocomposites can be described as mixtures of oxidizer and fuel where both phases have nanoscale particle morphologies, which enable prompt energy release (e.g., explosives, pyrotechnics, propellants, etc.). Presently, energetic nanocompositions, while displaying impressive combustion characteristics, have significant drawbacks. First, typical energetic nanocompositions rely on nanoscale aluminum which is costly, difficult to procure and produce, and suffers from a certain degree of batch-to-batch variation which leads to safety and reproducibility issues. Second, typical energetic nanocompositions are formulated by simple powder mixing and drying and thus are susceptible to microstructural heterogeneities that result from poor mixing methods, density mismatching of components, and especially agglomeration of constituent materials. These drawbacks combine to result in physical mixtures of oxidizer and fuel that rely on random mixing of agglomerated dry powders, which leads to micro-domains of fuel rich and oxidizer rich regions, which results in poor performance.

As the physical dimensions of an energetic material system become miniaturized, these heterogeneities begin to approach the length scale of the device's features, which leads to unstable combustion, irreproducible ignition regimes, and inconsistent failure diameters.

The fabrication of an OEN engineered from a well-defined structured template, whose geometric constraints provide ordered deposition of the secondary reactant phase, is specifically addressed by some embodiments of the invention. These ordered systems have superior and more reproducible energy release properties than those derived from physically mixed nanopowders, which is typical in the field currently. These properties are a result of a maximization of the productive fuel/oxidizer interactions that are facilitated by the intimate and structured nature of the OEN.

In one approach, OEN may be assembled using a bottom-up approach that utilizes an energetic metal fuel, such as silicon (Si), as a reactant. The materials and approach are compatible with existing manufacturing capabilities in the electronics industry, specifically the semiconductor industry. Specifically, OEN's including Si nanowire arrays and/or porous Si materials are possible using current semiconductor manufacturing techniques. The Si materials possess nanostructural features which are extremely accessible, have high surface areas, and can be made with highly reproducible structures. High energy density combinations of Si and solid oxidizers may be utilized in some embodiments. The large amount of interfacial surface contact area reduces diffusion distances and leads to reaction rates up to 1000 times that of conventional energetic composites (micron powder mixtures). In addition, the fabrication methods are versatile which should allow the tailoring of the energetic response through either varying fundamental component sizes or through using different ratios of oxidizers and/or fuels.

In one embodiment, OEN may be derived from metal fuel nanowires. Specifically, the nanowires may include Si. OEN based on Si nanowire networks may be fabricated using a two-step process. In the first step, arrays of Si nanowires, with each nanowire being orderly positioned in a uniform direction and spaced about equally from each other, may be prepared using vapor-liquid-solid (VLS) deposition techniques. Using this approach, one-dimensional separate silicon nanowires may be grown on a Si substrate containing a gold catalyst, or any other catalyst as would be known to one of skill in the relevant art.

In the second step, the void between individual Si nanowires may be filled with one or more oxidizers by solution deposition. Two types of oxidizers that may preferably be used include a metal oxide and an inorganic salt. Metal oxides may be deposited using sol-gel techniques. Sol-gel techniques enable the formation of nanometer-sized metal oxides such as iron oxide, tungsten (VI) oxide, and copper (II) oxide. All of these metal oxidizers may undergo highly exothermic and self-sustaining oxidation reactions with the Si fuel metal. The second class of oxidizers, inorganic salts such as nitrate, perchlorate anions, etc., may also be fabricated by deposition from solution by cycles of infusion and evaporation.

Figure 4:
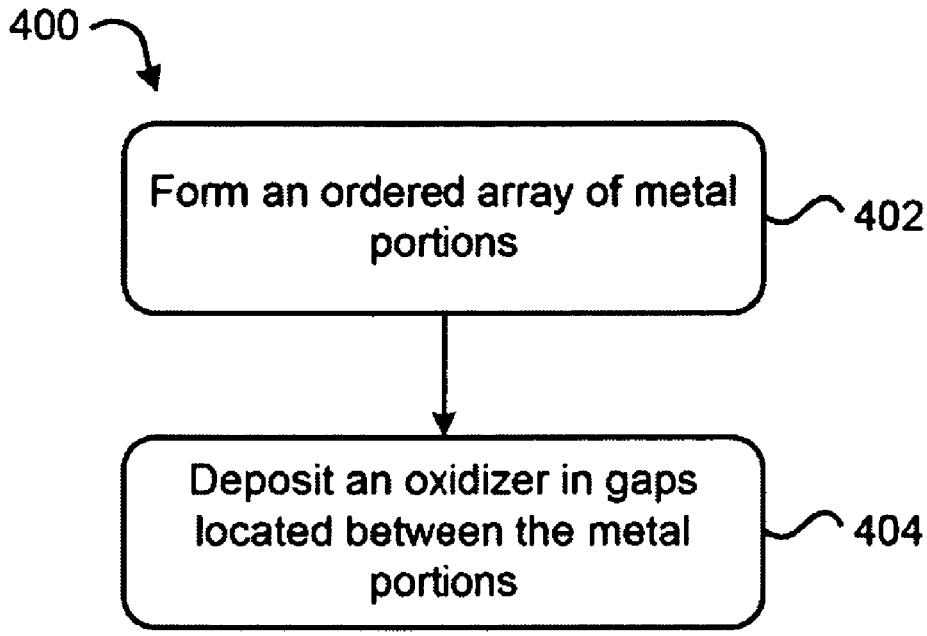
FIG. 4 shows a method according to one embodiment.

Now referring to FIG. 4, a method 400 for forming an ordered energetic composite structure is described. The method 400 may be carried out in any desired environment.

Any of the features and embodiments described in reference to FIGS. 1-3C may be applied to the description of method 400.

In operation 402, an ordered array of metal fuel portions is formed. Any technique may be used to form the ordered array of metal fuel portions, as would be known to one of skill in the relevant art.

In some embodiments, the ordered array of metal fuel portions may be formed at least in part by growing nanowires on seeded sites, e.g., by using electroplating. The sites may be seeded with gold, or any other metal as would be known to one of skill in the relevant art.

In one approach, forming the ordered array of metal fuel portions may include patterning a solid substrate and removing exposed portions of the solid substrate for defining nanowires. For example, a mask may be formed above areas of the substrate that are to remain, while the exposed areas not under the mask may be removed. Illustrative removal methods include etching, milling, etc. In another approach, nanowires may be grown in pores of a patterned template, and the template may be removed, e.g., via use of a solvent.

In other approaches, the metal fuel portions may include a material selected from a group consisting of silicon, copper and aluminum. Of course, more materials may be used as would be known to one of skill in the relevant art.

In operation 404, an oxidizer is deposited in gaps located between the metal portions.

In some approaches, the oxidizer may completely or almost completely fill the gaps located between the metal fuel portions. In other approaches, the oxidizer may only partially fill the gaps located between the metal fuel portions. For example, the oxidizer may only coat the metal fuel portions and leave the remaining interstitial space between the metal fuel portions void, possibly to be filled by some other material. Of course, more than one oxidizer may be used in a mixed form, in layers, in an ordered arrangement, etc.

In some preferred embodiments, the oxidizer may be deposited using a sol-gel process. This type of formation tends to provide the most homogeneous dispersement of oxidizer.

In more embodiments, the oxidizer may be a metal oxide such as iron oxide, tungsten oxide, and/or copper oxide. Other metal oxides may also be used, and more than one metal oxide may be used.

In some approaches, the oxidizer may be deposited using a series of applications of solution of the oxidizer in a solvent or carrier followed by evaporation of the solvent or carrier. This type of formation tends to form layers of oxidizer. Of course, more than one oxidizer may be used, and the layers may be of a single oxidizer, a mix of oxidizers, an ordered arrangement of oxidizers, etc. In further approaches, the oxidizer may be an inorganic salt and/or perchlorate anions, as previously described.

In some embodiments, the diameter of individual nanowires as well as the surface coverage of the Si nanowires on the substrate may be tuned by varying the dimensions and/or sites of the gold or other metal catalyst. The dimensions and spacing of the nanowires may dictate the void volume and hence may affect the amount of oxidizer(s) that may be loaded between the nanowires. This allows for varying reaction rates, reaction yields, energy output, etc., from a number of different metal fuel/oxidizer mixes and the determination of loadings for optimal properties.

Figure 1B:
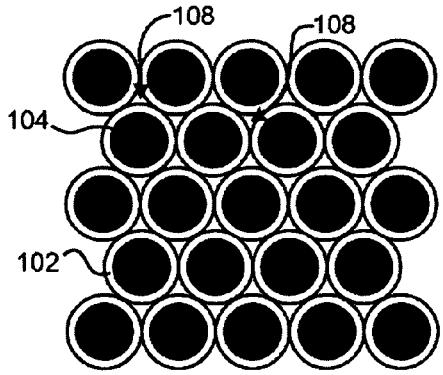
FIG. 1B shows a top-view schematic of an ordered energetic composite structure according to one embodiment.

Now referring to FIGS. 1A-1D, in some embodiments, an ordered energetic composite structure 100, which may be an OEN but is not so limited, includes an ordered array of metal fuel portions 104. By "ordered" what is meant is that some degree of control has been exerted over the positions and/or orientations of the metal fuel portions 104, as opposed to a random array such as would be found in a mixture of powders, for example. The ordered energetic composite structure 100 also includes an oxidizer 102 in gaps located between the metal fuel portions 104. Preferably, the oxidizer 102 is in intimate contact with the metal fuel 104 in any of the embodiments described herein. For example, the oxidizer 102 may coat the exterior surfaces of nanowires of the metal fuel 104, arranged in an array, as shown in FIGS. 1A and 1B. The metal fuel portions 104 may be above a substrate 106, according to some embodiments.

In FIG. 1B, a top view of the ordered energetic composite structure 100, the interstitial spaces 108 between the metal fuel portions 104 can more clearly be seen. The oxidizer 102 may coat each metal fuel portion 104 as shown, or may coat only some of the metal fuel portions 104, or may coat only portions of all metal fuel portions 104, etc.

Figure 1C:
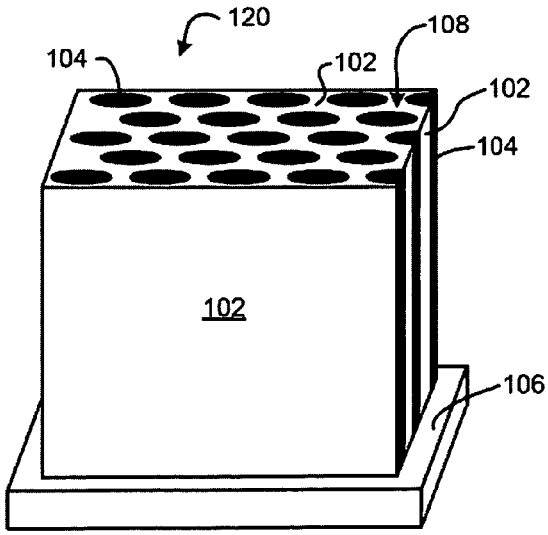
FIG. 1C shows a side-view schematic of an ordered energetic composite structure according to one embodiment.
Figure 1D:
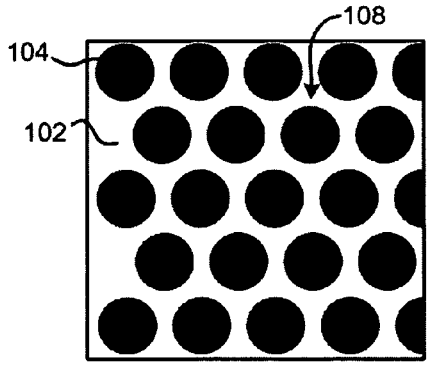
FIG. 1D shows a top-view schematic of an ordered energetic composite structure according to one embodiment.

In another example, as shown in FIGS. 1C and 1D, the oxidizer 102 may fill the interstitial spaces 108 between the metal fuel nanowires 104. Many other arrangements and orientations are possible, of course, as would be known to one of skill in the relevant art.

According to some embodiments, an ordered energetic composite structure 100 may include metal fuel portions 104 which include nanowires, positioned over a seeded site, e.g., a gold seed. As used herein, "nano" is meant to refer to a dimension of less than about 1 micron. As used herein, "micro" is meant to refer to a dimension of less than about 1000 microns. Such dimensions may refer to a diameter, a length, a width, etc.

In more embodiments, the metal fuel portions 104 may include nanowires having physical features characteristic of having been formed by etching from a solid substrate 106. Illustrative characteristics include substantially straight axes, about parallel axes, sidewall surfaces characteristic of directional etching, etc.

Also, in some preferred embodiments, the metal fuel portions 104 may comprise a material selected from a group consisting of silicon, copper and aluminum. Other metals may be chosen as well, and the invention is not limited to only these three metals.

In some approaches, the oxidizer 102 may completely or almost completely fill the gaps 108 located between the metal fuel portions 104. In other approaches, the oxidizer 102 may only partially fill the gaps 108 located between the metal fuel portions 104.

Figure 2A:
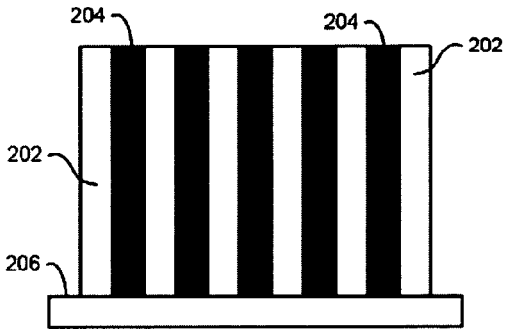
FIGS. 2A-2H show simplified side-view schematic diagrams of ordered energetic composite structures according to several embodiments.

Now referring to FIGS. 2A-2H, more embodiments of ordered energetic composite structure may be described according to several embodiments. In each FIG. 2A-2H, only a portion of an ordered energetic composite structure is shown. In FIG. 2A, in one approach, metal fuel portions 202 may be above a substrate 206, with oxidizer completely filling the gaps between the metal fuel portions 202.

Figure 2B:
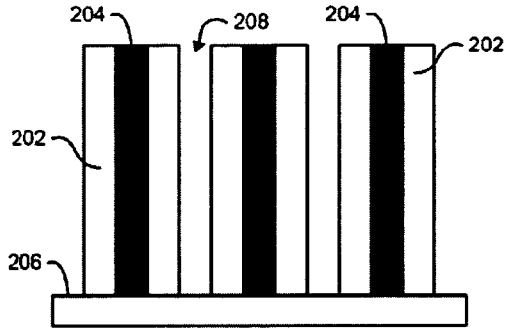

In another approach, as shown in FIG. 2B, oxidizer 204 may fill some of the gaps 208 between the metal fuel portions 202, and may leave some gaps 208 unfilled. Of course, this pattern may be repeated across the entire structure, as FIG. 2B only shows a portion of an ordered energetic composite structure.

Figure 2C:
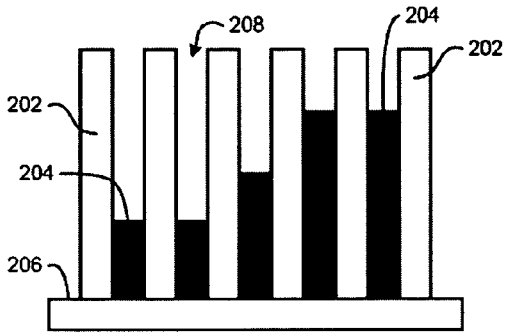

In another approach, as shown in FIG. 2C, oxidizer 204 may partially fill the gaps 208 between the metal fuel portions 202. How much of the gap 208 is filled may depend on the desired characteristics of the resulting ordered energetic composite structure. Typically, each gap 208 may be filled with the same amount of oxidizer 204, but changing the amount of oxidizer 204 is also possible across the entire ordered energetic composite structure.

Figure 2D:
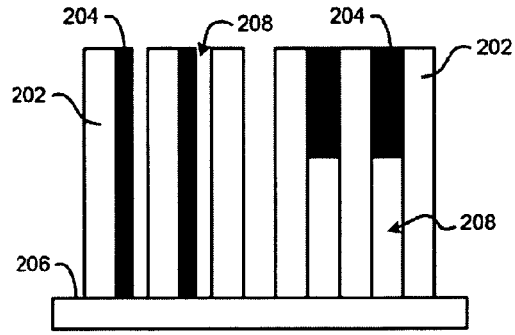

In yet another approach, as shown in FIG. 2D, oxidizer 204 may partially fill the gaps 208 between the metal fuel portions 202, but instead of being near the lower portion of the metal fuel portions 202, the oxidizer 204 may be formed on one side of the metal fuel portions 202, or near a top portion of the metal fuel portions 202. This may leave a gap 208 below an oxidizer 204, possibly near a substrate 206.

Figure 2E:
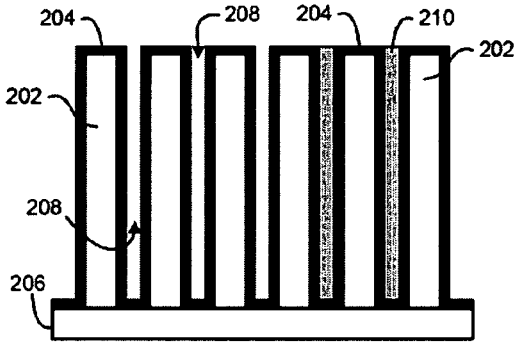

Now referring to FIG. 2E, another embodiment is shown where the oxidizer 204 may be formed on the surface of the metal fuel portions 202. In addition, a second oxidizer 210 may be included in the gap 208 left by the coated oxidizer 204 on the surfaces of the metal fuel portions 202.

Figure 2F:
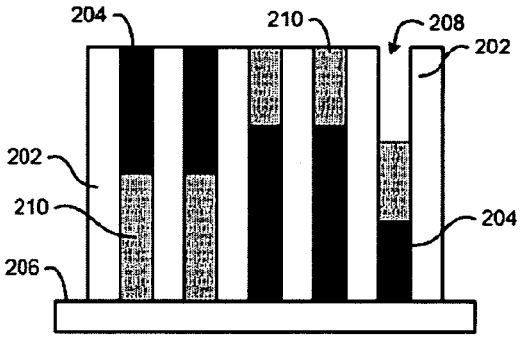

In another embodiment, as shown in FIG. 2F, the two oxidizers, 204 and 210, may partially fill the gaps 208 between the metal fuel portions 202. Also, each oxidizer 204 and 210 may be formed in a single gap 208, may be alternated according to a desired pattern, may completely fill the gap 208 when formed together, etc. Of course, many more embodiments may be possible when using more than one oxidizer, and each possible embodiment cannot be presented here, but are to be included in the scope of the claimed invention.

Figure 2G:
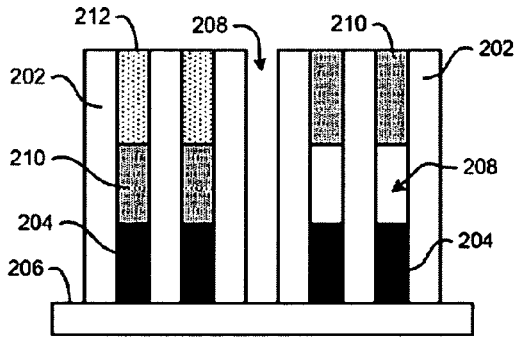
Figure 2H:
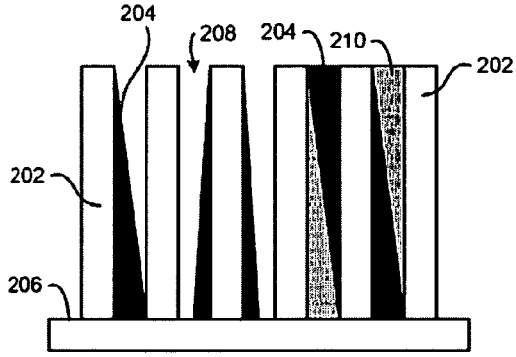

For example, in an embodiment shown in FIG. 2G, a third oxidizer 212 is shown combined with the other two oxidizers 204 and 210. Of course, the third oxidizer 212 may be a mixture of the other two oxidizers 204 and 210, or it may be a completely different oxidizer. Also, even with multiple oxidizers, a gap 208 may still be left between the metal fuel portions, in any location.

In FIG. 211, another embodiment is shown where oxidizer 204 may be formed in multiple layers or in varying thicknesses across the metal fuel portions 202. Also, a second oxidizer 210 may be formed along with the first oxidizer 204, such that each oxidizer has a varying thickness across the metal fuel portions 202. The oxidizer may also be formed on either side of each metal fuel portion 202, or only on one side.

In another embodiment, an OEN may be based on a porous metal fuel (such as Si) patterned by soft lithography. The ability to pattern the porous Si/oxidizer composites into microstructures with intricate geometric features may greatly increase the effectiveness of these composites. Dry-removal soft lithography may be used to deposit the energetic composite on a variety of length scales and geometries such as to vary the output, reaction rates, etc., as a function of those features.

Porous silicon (pSi) may be formed by electrochemically controlled etching to yield materials with highly reproducible small pore diameters and depths. In addition, combining the electrochemically controlled etching with solution deposition of oxidizers may create patterned pSi-based energetic materials. Oxidizers deposited from solution may be sol-gel derived nano-sized metal oxides such as $WO_3$, $Fe_2O_3$, CuO and/or inorganic salts containing oxidizing anions, such as perchlorate, nitrate, etc. Sol-gel deposition techniques may form small particle sizes and may provide for almost complete coverage or complete coverage of the pSi surface.

Figure 3A:
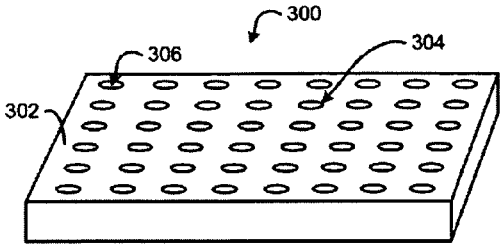
FIG. 3A shows an isometric diagram an ordered energetic composite structure including nanopores according to one embodiment.

In one embodiment, as shown in FIG. 3A, an ordered energetic composite structure 300, which may be an OEN but is not so limited, includes at least one metal fuel portion 302 having an ordered array of nanopores 304. By "ordered" what is meant is that some degree of control has been exerted over the positions and/or orientations of the pores, as opposed to a random array such as would be found in a mixture of powders, for example. The ordered energetic composite structure 300 also includes an oxidizer 306 in the nanopores 304. By "in" what is meant is that the nanopores 304 may have a portion thereof filled with an oxidizer 306.

Figure 3B:
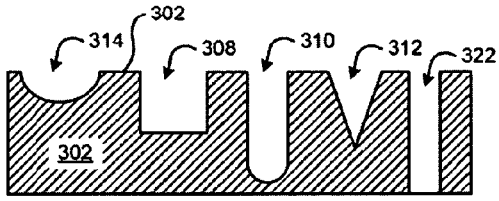
FIG. 3B shows nanopores profile shapes according to several embodiments.

In FIG. 3B, several nanopores 304 are shown according to several embodiments. Typically, the shape of nanopores 304 may be determined by the formation technique and will be relatively uniform across the array. However, rounded nanopores 314, squared nanopores 308, tube-like nanopores 310, and trenched or cone-like nanopores 312 are shown as examples of the many different variations possible using different formation techniques. In addition, the nanopores 304 may be formed through the metal fuel portion 302, like that shown as 322, such that a void space may extend through the metal fuel portion 302, possibly to a substrate (not shown) located below the metal fuel portion 302. Moreover, the nanopores 304 may terminate in the metal fuel portion 302 and/or may extend completely therethrough. In more approaches, the nanopores 304 may extend through the metal fuel portion 302, and may be filled with an oxidizer (not shown), such that the oxidizer may contact a surface below the metal fuel portion 302.

In some preferred embodiments, the metal fuel portions 302 may comprise a material selected from a group consisting of silicon, copper and aluminum. Of course, many other metals may be used, and the invention is not limited to these three metals only.

Figure 3C:
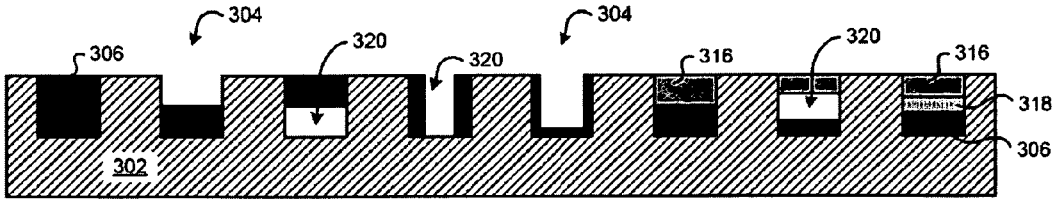
FIG. 3C shows nanopores including oxidizers according to several embodiments.

As shown in FIG. 3C, depicting several embodiments, the oxidizer 306 may completely or almost completely fill the nanopores 304. In other embodiments, the oxidizer 306 may only partially fill the nanopores 304, leaving some portion of the nanopores 304 without oxidizer 306. For example, the oxidizer 306 may coat the interior surfaces of the nanopores 304, while leaving the void space 320 between the interior walls of the nanopores 304 without oxidizer 306. Of course, other materials may be included in the nanopores 304 in addition to the oxidizer 306, and more than one oxidizer may be included.

For example, some of the nanopores 304 shown in FIG. 3C include a second oxidizer 316, and others include a third oxidizer 318. One or more oxidizers may be included in each nanopore 304. In addition, void space 320 may be included in each nanopore 304 in addition to some oxidizer, such as oxidizer 306.

Figure 5:
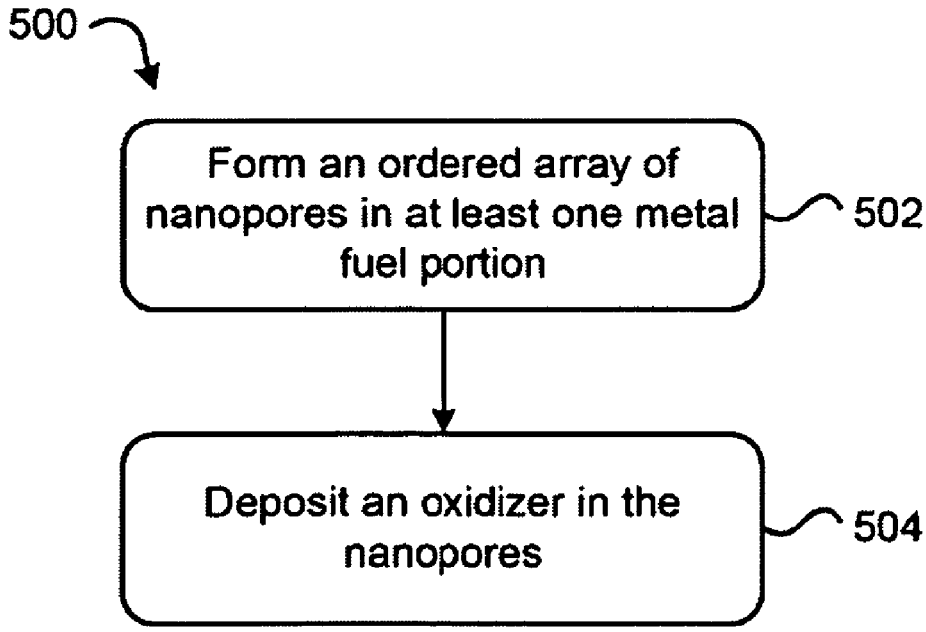
FIG. 5 shows a method according to another embodiment.

With reference to FIG. 5, a method 500 for forming an ordered energetic composite structure is described. The method 500 may be carried out in any desired environment. Any of the features and embodiments described in reference to FIGS. 1-3C may be applied to the description of method 500.

In operation 502, an ordered array of nanopores is formed in at least one metal fuel portion. Any technique may be used to form the ordered array of nanopores, as would be known to one of skill in the relevant art.

In some embodiments, forming the ordered array of nanopores may include patterning one or more metal fuel portions and removing exposed portions of the one or more metal fuel portions. Illustrative removal methods include etching, milling, etc.

In operation 504, an oxidizer is deposited in the nanopores. According to some embodiments, the oxidizer may completely fill or almost completely fill the nanopores. In other embodiments, the oxidizer may only partially fill the nanopores.

In some approaches, the oxidizer may be deposited using a sol-gel process. This type of formation tends to provide the most homogeneous dispersement of oxidizer. A homogenous dispersement of oxidizer is favored as it may lead to a more complete and uniform reaction of the metal fuel. In some further approaches, the oxidizer may be a metal oxide such as iron oxide, tungsten oxide, and copper oxide.

In more approaches, one or more metal fuel portions may include a material selected from a group consisting of silicon, copper and aluminum. Of course, other metals may be used, and the invention is not limited to these three metals alone.

In some embodiments, the oxidizer may be deposited using a series of applications of solution of the oxidizer in a solvent or carrier followed by evaporation of the solvent or carrier. This type of formation tends to form layers of oxidizer. Of course, more than one oxidizer may be used, and the layers may be of a single oxidizer, a mix of oxidizers, an ordered arrangement of oxidizers, etc. In further approaches, the oxidizer may be an inorganic salt and/or perchlorate anions, as previously described.

There are many uses for the various embodiments of the present invention. In particular, this technology enables a myriad of new Micro-Electro-Mechanical Systems (MEMS) devices for use in defense applications such as: sensors, detonators, detonator arrays, actuators, microthrusters, energetic logic circuits, etc. Also, these types of microenergetic materials and systems may be useful in the automotive industry (such as for air-bag igniters), the health sciences (such as for microsyringe injectors), the electronics industry (such as for anti-tamper devices), etc.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An ordered energetic composite structure, comprising:
an ordered array of metal fuel portions; and
an oxidizer in gaps located between the metal fuel portions.

2. The structure of claim 1, wherein the metal fuel portions include nanowires, positioned over a seeded site.

3. The structure of claim 1, wherein the metal fuel portions include nanowires having physical features characteristic of having been formed by etching from a solid substrate.

4. The structure of claim 1, wherein the metal fuel portions comprise a material selected from a group consisting of silicon, copper and aluminum.

5. The structure of claim 1, wherein the oxidizer completely fills the gaps located between the metal fuel portions.

6. The structure of claim 1, wherein the oxidizer only partially fills the gaps located between the metal fuel portions.

7. An ordered energetic composite structure, comprising:
at least one metal fuel portion having an ordered array of nanopores; and
an oxidizer in the nanopores.

8. The structure of claim 7, wherein the metal fuel portions comprise a material selected from a group consisting of silicon, copper and aluminum.

9. The structure of claim 7, wherein the oxidizer completely fills the nanopores.

10. The structure of claim 7, wherein the oxidizer only partially fills the nanopores.

* * * * *